United States Patent [19]

James

[11] 4,149,602

[45] Apr. 17, 1979

[54] HYDRAULICALLY-OPERATED PERCUSSIVE DEVICE

[75] Inventor: David R. James, Hasfield, England

[73] Assignee: A. F. Hydraulics Limited, Gloucester, England

[21] Appl. No.: 854,028

[22] Filed: Nov. 22, 1977

[30] Foreign Application Priority Data

Dec. 10, 1976 [GB] United Kingdom ..... 51570/76

[51] Int. Cl.[2] ..... B25D 9/00

[52] U.S. Cl. ..... 173/134; 91/321

[58] Field of Search ..... 173/134, 135, 136, 137, 173/138, 139; 92/85 R, 85 B; 91/300, 321

[56] References Cited

U.S. PATENT DOCUMENTS

| | | | |
|---|---|---|---|
| 3,411,592 | 11/1968 | Montabert | 91/321 |
| 3,490,549 | 1/1970 | Catterson | 173/134 |
| 3,887,019 | 6/1975 | Reynolds et al. | 173/134 |
| 3,908,767 | 9/1975 | Klemm | 91/300 |
| 3,955,478 | 5/1976 | Feucht | 173/134 |
| 4,028,995 | 6/1977 | Salmi et al. | 91/300 |
| 4,070,949 | 1/1978 | Salmi | 91/321 |

*Primary Examiner*—Robert A. Hafer

*Attorney, Agent, or Firm*—Cushman, Darby & Cushman

[57] ABSTRACT

A hydraulically-operated percussive device comprises a piston/striker reciprocable in a housing and valve means adapted to intermittently pressurize a working area of the piston/striker to produce forward working strokes thereof. The housing contains a chamber adapted to be pressurized by the hydraulic working fluid to apply a continuous return force to a differential return area of the piston/striker which has a step arranged to enter a dashpot cavity at one end of the chamber to damp forward movement and thereby limit overstroking of the piston/striker. The piston/striker has an intermediate flanged portion which is a close sliding fit in the chamber end regions of which are interconnected through a conduit so that both annular end faces of the flanged portion are subject to the fluid pressure. The end faces are of different efective areas with the difference providing said differential return area and the larger end face providing the step.

10 Claims, 1 Drawing Figure

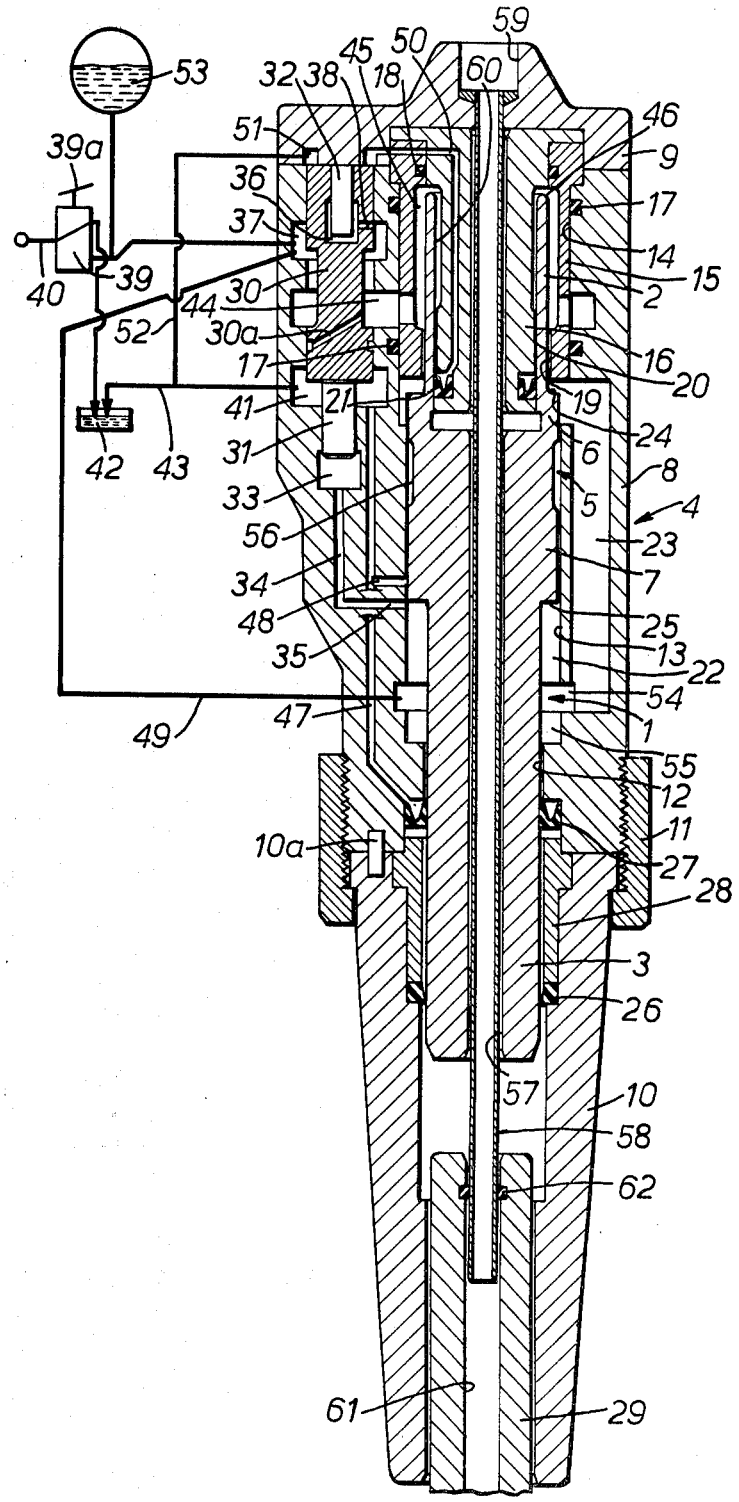
59
53
32
38
45
50
18
60
46
51
9
39a
36
17
37
14
15
39
2
40
44
30
52
30a
16
17
20
21
19
41
24
42
43
31
6
8
33
5
4
56
23
34
7
48
25
35
13
22
54
47
1
49
55
12
11
10a
27
28
3
26
57
10
58
62
61
29

HYDRAULICALLY-OPERATED PERCUSSIVE DEVICE

BACKGROUND OF THE INVENTION

1. Field of the Invention

This invention relates to hydraulically-operated percussive devices of the type having a piston/striker adapted to impart a succession of blows to a tool and associated with damping means which operate with a dashpot snubbing action to limit the forward working strokes of the piston/striker. Such damping means are commonly employed with devices in the form of road breakers and rock drills, often being inoperative during normal working but coming into operation to prevent overstroking of the piston/striker in the event that the tool either breaks through or is lifted off the work.

2. Description of the Prior Art

The damping means may employ a step on the piston/striker which enters a dashpot recess at one end of a chamber in which hydraulic fluid pressure acts on the piston/striker to produce return stokes thereof. In this case the pressure acts on the damping step and whereas damping, particularly with a high power tool, demands a large piston damping area the requirements of efficiency demand a low differential piston area on which the return pressure acts. The latter is particularly the case with tools of the class in which said chamber is continuously pressurised during tool operation, with the result that the return piston force is applied at all times even during the forward working strokes and hence must be kept as low as practicable.

In order to meet the conflicting requirements of a large piston damping area and a small piston return area, without a need for disadvantageous compromise between these areas, two arrangements have been proposed. U.S. Pat. No. 3,887,019 discloses a device with a flange on the piston/striker which is freely movable in said chamber and has different annular end areas, one such area providing the large area damping step and the difference between these annular areas providing the differential piston return area. While this is a satisfactory solution to the problem it necessitates a large diameter chamber with adequate clearance around said flange and complicates the design. In the other arrangement disclosed in U.S. Pat. No. 3,490,549 a completely separate damping chamber with its own end seals is provided, the piston/striker having a damping flange movable in this chamber. This increases the length of the device by a complete stroke plus the dimensions of the additional sealing arrangements, and thus also has the disadvantage of introducing structural complications as well as additional weight.

SUMMARY OF THE INVENTION

The object of the invention is to provide a device which, generally speaking, has the advantages of both said proposed prior arrangements while overcoming the disadvantages thereof.

To this end the invention provides a hydraulically-actuated percussive device comprising a piston/striker reciprocable in a housing and valve means adapted to intermittently pressurise a working area of the piston/striker to produce forward working strokes thereof, the housing containing a chamber adapted to be pressurised by the hydraulic working fluid to apply a continuous return force to a differential return area of the piston/striker with a step on the latter arranged to enter a dashpot cavity at one end of said chamber to damp forward movement and limit overstroking of the piston/striker, and wherein the piston/striker has an intermediate flanged portion which is a close sliding fit in said chamber and end regions of the chamber are interconnected so that both annular end faces of the flanged portion are subject to the fluid pressure, said annular end faces being of different areas with the difference providing said differential return area and the larger end face providing said step arranged to enter the dashpot cavity.

As the flanged portion is a close fit in said chamber the overall dimensions of the housing are reduced as compared with said prior flanged arrangements, and further advantages are obtained if the flanged portion is provided by two axially spaced flanges and the axial space between these flanges is used for valve control purposes. Thus the wall of the chamber may be provided with two ports, namely a valve control port and an exhaust port, which are interconnected through the inter-flange space when the piston/striker is at the end of a forward stroke and the valve control port arranged so that it is uncovered by the forward flange, and hence open to the fluid pressure in said chamber, at the end of a return stroke. With such an arrangement the valve means conveniently employ differential pilot operation, being constantly urged to the return stroke position and moved over to the forward stroke position when said valve control port is uncovered. A valve arrangement of this nature is described in said U.S. Pat. No. 3,887,019 and the general arrangement whereby the intermittent forward driving pressure is applied to the piston/striker may also be as described in that specification.

Other features of the invention will be apparent from the following description, drawing and claims, the scope of the invention not being limited to the drawing itself as the drawing is only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

BRIEF DESCRIPTION OF THE DRAWING

A hydraulically-operated percussive device designed for use as a road breaker and embodying the invention is illustrated, somewhat diagrammatically and by way of example, in the accompanying drawing which shows the device in axial section.

DESCRIPTION OF THE PREFERRED EMBODIMENT

A hollow piston/striker 1 with an annular piston portion 2 and a reduced diameter striker portion 3 is reciprocable in a housing 4. An intermediate flanged portion 5 of the piston/striker 1 comprises two axially spaced flanges 6 and 7. The piston/striker 1 as shown is a one-piece member; however, it could comprise separate piston and striker portions, with the flanges 6 and 7 formed on either of these portions.

The housing 4 comprises a main body portion 8, a head end closure portion 9 attached to the body portion 8 by bolts (not shown), and a tapering nose portion 10 attached to the body portion 8 by a screw-threaded clamp ring 11. The body portion 8 is bored through from the left on three progressively decreasing diameters, providing in reverse order a nose end bore 12, an intermediate bore 13 and a head end bore 14. An inset sleeve 15 and coaxial inner tubular stem member 16 mounted in the bore 14 are flanged so as to be held in position by the housing portion 9. The sleeve 15 is sealed with respect to the bore 14 by seals 17, and with respect to the tubular member 16 by a seal 18. An inner end bore 19 of the sleeve 15 is a close sliding fit around the annular piston portion 2, and the tubular member 16 has an inner end peripheral section 20 which is a close sliding fit within the piston portion 2. The member 16 is sealed with respect to the piston portion by a seal 21 disposed inwardly of the end section 20. Fitting of the sleeve 15, to provide the inner bore 19 of smaller diameter than the bore 13, facilitates boring of the main body portion 8 from the head end thereof. This advantage obtains provided the bore 14 is at least as large in diameter as the bore 13.

The flanges 6 and 7 are movable with a close sliding fit in the intermediate bore 13 and the striker portion 3 is a close sliding fit in the bore 12, to define within the housing a cylindrical chamber 22 in which the flanged portion 5 reciprocates. The opposite end regions of this chamber are interconnected through a large bore conduit 23 so that the same hydraulic pressure acts on steps 24 and 25 provided respectively by the outer annular end faces of the flanges 6 and 7. Attachment of the nose portion 10 by the clamping ring 11 also retains a seal arrangement comprising axially spaced seals 26 and 27 separated by a spacer sleeve 28 and which provide a seal for the striker portion 3. The nose portion 10 has tool holding means (not shown) which are of conventional form and by which a tool steel 29 is detachably secured to the device. These means can be of any well-known form, and tool rotating means which again can be of known form may be embodied in or fitted to the nose portion 10, rotation of the nose portion 10 being prevented by a locating dowel 10*a*. .

A differentially biassed control valve 30 mounted in the housing portion 8 comprises a valve spool reciprocable, under the control of differential pilot pistons 31 and 32, alongside and parallel to the piston portion 2. The pilot piston 31 is of larger diameter than the piston 32 and is subject to hydraulic pressure in a pilot chamber 33 which is connected through a passage 34 to a valve control port 35 in the bore 13. To keep the valve arrangement within acceptable axial dimensions the smaller pilot piston 32 is of reversed stationary form, one end of this piston bearing against the housing portion 9 and the other end projecting into a pilot chamber 36 within the valve 30 itself. The chamber 36 communicates with an annular pressure inlet port 37 of the valve through a radial bore 38 in the valve spool. The valve port 37 communicates through an ON/OFF valve (shown diagrammatically at 39) with a hydraulic inlet supply connection (not shown) which is connected to a hydraulic pressure source through a supply hose 40.

The housing 4 has side handles, not visible in the view shown, by which the device is held when in use. The ON/OFF valve 39 is built into the housing and has an operating lever 39*a* which in known manner overlies one of the handles and is grasped therewith to operate the valve 39 and bring the device into operation by connecting the hydraulic supply to the valve port 37. The valve 39 is spring loaded to the OFF position shown in which the hydraulic supply is off loaded, enabling the hose 40 to be supplied from a constant displacement pump matched to the device. The ON/-OFF valve may operate in other ways, for example being in the form of an isolating check valve associated with one of the pilot pistons of the valve 30, or a simple ON/OFF valve for use with a constant pressure supply.

An annular exhaust port 41 at the opposite end of the control valve 30 communicates with a hydraulic exhaust return connection (also not shown) which is connected back to the hydraulic supply tank 42 through a return hose 43. Separate hydraulic supply and return hoses 40 and 43 may be employed, although if desired a coaxial hose arrangement may be used. An intermediate annular valve port 44 is alternately connected by reciprocating of the valve 30 to the pressure port 37 and to the exhaust port 41 via a passage 30*a* through the valve 30 itself. The port 44 communicates with an annular working chamber 45 defined between the sleeve 15 and the tubular member 16, the sleeve 15 and member 16 being cut away rearwardly of the end bore 19 and the end section 20 respectively to provide this chamber. The intermittent pressure in this chamber 45 acts on the working area of the piston/striker 1 provided by the annular end face 46 of the piston portion 2 to produce forward working strokes of the piston/striker 1. An exhaust passage 47 in the housing portion 8 connects a valve exhaust port 48 in the bore 13 to the valve exhaust port 41, and this passage also collects leakage along the bore 12 which reaches the seal 27. The chamber 22 is connected to the valve pressure port 37 by a further passage formed within the housing portion 8 and which is illustrated diagrammatically at 49.

The seal 21 is vented by a passage 50 which collects leakage reaching this seal from the chamber 45, and this passage drains into an annular exhaust groove 51 formed in the housing portion 9. A further passage, shown diagrammatically at 52, connects the groove 51 to the exhaust return connection. The device also includes a gas-charged accumulator, shown diagrammatically at 53, with a diaphragm which acts on the pressure feed to the valve port 37 to provide a pulse-smoothing action in known manner. This accumulator is preferably in the form of a replaceable cartridge unit, fitted into the head end portion 9 or attached at a suitable position to the side of the housing 4.

In the drawing the device is shown in the inoperative rest position, which corresponds to the end of a return stroke with the control valve member 30 just changed over and in the working stroke position. Opening of the ON/OFF valve 39 thus pressurises the chamber 45 to initiate a working stroke of the striker/piston 1.

During operation of the device the chamber 22 is continuously pressurised by the hydraulic fluid through the passage 49, the opposite end regions of this chamber being interconnected through conduit 23. Thus the hydraulic pressure acts on the two steps 24 and 25, and as the step 25 is of larger area than the step 24 they provide a differential area on which the pressure acts to produce a continuous return force on the piston/striker 1. As this force is continuous and has to be overcome during the forward strokes the differential area is in the interests of efficiency kept as small as practicable, merely being sufficient to provide an adequate force to produce return strokes of the piston/striker 1 when the chamber 45 is not pressurised.

The forward end connection of the conduit 23 with the chamber 22 at 54 is spaced from the forward end of the chamber 22, this spacing enabling the forward end portion 55 of the chamber 22 to act as a dashpot cavity which is entered by the flange 7 to damp the forward movement with a snubbing action and hence arrest the piston/striker 1 to prevent overstroking thereof. When the device is working normally the dashpot action is not required, but it comes into play when the tool steel 29 breaks through or is lifted off the work. In these circumstances the damping action, in order to arrest the piston/striker 1 rapidly, requires a large effective damping area which is provided by the step 24 formed by the end face of the flange 7. The described arrangement utilising two flanges 6 and 7, one of which provides the damping area whereas the two together provide the differential return area, enables these two areas to be chosen independently for optimum working characteristics, i.e. the differential area can be made as small as practicable in the interests of efficiency whereas the damping area can be made as large as necessary for adequate damping.

As the flanges 6 and 7 are a close sliding fit in the chamber 22 the inter-flange space 56 enables the flange portion 5 of the piston/striker 1 to be used for valve control purposes in cooperation with the valve control port 35 and the exhaust port 48. When the piston/striker 1 reaches the end of a return stroke, i.e. the position shown in the drawing, the port 35 is uncovered and the hydraulic pressure in the chamber 22 acts on the pilot piston 31 to overcome the action of the pilot piston 32 and change over the valve 30 to pressurise the piston area 46 thereby initiating the next working stroke of the piston/striker 1.

During a working stroke the port 35 is closed off by the flange 7, providing a hydraulic lock which retains the valve 30 in the working stroke position which pressurises the piston area 46. At the end of a normal working stroke the port 35 is uncovered by the rear edge of the flange 7 and communicates with the exhaust port 48 through the inter-flange space 56. This relieves pressure from the pilot piston 31 and the pressure in the pilot chamber 36 acts to move the valve 30 relatively to the fixed pilot piston 32 to the exhaust position, i.e. to the right-hand position in the drawing, so that the piston/striker 1 commences a return stroke as the chamber 45 is valved to exhaust.

As described the piston/striker is hollow, this member being provided with a through bore 57 providing clearance for a fixed tubular duct 58 for flushing fluid supplied to a head end connection 59. A counterbore 60 at the head end of the piston/striker 1 provides the inner diameter of the annular piston portion 2. The flushing fluid may be air or water, and the tubular duct 58 extends through the piston/striker 1 and projects therefrom into a through bore 61 in the tool steel 29 which it engages through a seal 62.

In a modified construction, not illustrated, the tubular duct 58 does not extend through the piston/striker 1 and into the tool steel 29, but terminates at the tubular member 16. This modification is designed for use with air as the flushing fluid.

A further modification, also not illustrated, omits the flushing arrangement and the bore 57 through the piston/striker 1 is omitted but the counterbore 60, which may be of reduced diameter, is retained as a closed-ended bore the end of which now provides the forward piston area instead of the annular end face 46 of the piston portion 2. Such a piston arrangement is described in said U.S. Pat. No. 3,887,019 and intermediate port 44 of the control valve in this modification is connected to the tubular member 16 to provide alternate pressurisation and exhaust of the forward piston area.

It will be appreciated that in the illustrated embodiment the effective area of the annular end face providing the step 24 is defined by the outer diameter of the flange 6 and by the outer diameter of the piston portion 2. In the case of the step 25, the inner diameter defining the effective area thereof is the diameter of the striker portion 3. The end portion 55 of the chamber 22 may be of slightly increased diameter to provide a small radial clearance with respect to the flange 7, to avoid the possibility of a hydraulic lock condition jamming the piston/striker in the dashpot cavity.

I claim:

1. A hydraulically-operated percussive device comprising a housing containing a chamber adapted to be continuously pressurised by the hydraulic working fluid and a dashpot cavity at one end of said chamber, a piston/striker reciprocable in said housing and having a working area and an intermediate flanged portion which is a close sliding fit in said chamber throughout the piston stroke, with one annular end face of the flanged portion providing a step arranged to enter said dashpot cavity to damp forward movement and thereby limit overstroking of the piston/striker, and valve means adapted to intermittently pressurise said working area of the piston/striker to produce forward working strokes thereof, end regions of said chamber on opposite sides of said flanged portion being permanently interconnected externally of the chamber and both annular end faces of said flanged portion being of different effective areas with the difference providing a differential return area on which the fluid pressure in said chamber acts to apply a continuous return force to the piston/striker with said one end face having the larger area.

2. A device according to claim 1, wherein said valve means comprises a pilot-operated control valve and said flanged portion has two axially spaced flanges with an axial space therebetween which is utilised for valve control purposes, a valve control port and an exhaust port being positioned in a wall of said chamber so as to be interconnected through said inter-flange space when the piston/striker is at one end of its stroke and so that said control port is uncovered by one of the flanges, and hence open to the fluid pressure in said chamber, at the other end of the stroke of the piston/striker.

3. A device according to claim 2, wherein said control valve employs differential pilot operation, being constantly urged to a return stroke position and moved over to a forward stroke position when said valve control port is uncovered at the end of a return stroke of the piston/striker.

4. A device according to claim 2, said control valve comprising two pilot pistons movable with respect to respective pilot chambers, one of which chambers is connected to said valve control port whereas the other is continuously connected to the fluid pressure supply to the device whereby to constantly urge the valve in one direction.

5. A device according to claim 4, wherein one of said pilot pistons is stationary and the associated pilot chamber is formed in the movable valve, this chamber communicating with a fluid pressure inlet port of the valve via a passage through the valve itself.

6. A device according to claim 2, wherein said control valve has a pressure inlet port, an exhaust outlet port and an intermediate port, said intermediate port being permanently connected to a working chamber contained in said housing and the fluid pressure in which acts on said working area of the piston/striker, said valve having one terminal position in which said inlet port communicates with said intermediate port to pressurise said working area and an alternative terminal position in which said intermediate port communicates with said outlet port via a passage through the valve itself whereby to exhaust the working chamber.

7. A device according to claim 1, said piston/striker being a one-piece member with said intermediate flanged portion disposed between reduced diameter end portions respectively providing a striker portion and a piston portion, said piston portion being of greater diameter than said striker portion.

8. A device according to claim 7, wherein said piston portion is of hollow annular form and said working area of the piston/striker is the annular end area of the hollow piston portion.

9. A device according to claim 7, said housing comprising a main body portion with bores of different diameter in which the striker portion and the intermediate flanged portion are respectively a sliding fit, and a sleeve fitted into the main body portion so as to be sealed relatively thereto and to surround said piston portion with an internal bore in which said piston portion is a sliding fit, the outer diameter of said sleeve being at least as great as that of said bore in which said flanged portion slides.

10. A device according to claim 9, wherein said piston portion is of hollow annular form with an annular end area which provides said working area of the piston/striker, and further comprising a stem member fitted coaxially within said sleeve so as to be sealed relatively thereto and to project into the piston portion which it engages with a sliding fit, said sleeve and stem member between them defining a working chamber in which the annular end of said piston portion reciprocates.

* * * * *